US007820896B2

(12) United States Patent
Wang

(10) Patent No.: US 7,820,896 B2
(45) Date of Patent: Oct. 26, 2010

(54) VIOLIN WITH STRUCTURAL INTEGRITY

(76) Inventor: Guobao Wang, No. 1 inside No. 19, Back Street, Southwest Village, Zhifu District, Yantai, Shandong 264000 (CN)

( * ) Notice: Subject to any disclaimer, the term of this patent is extended or adjusted under 35 U.S.C. 154(b) by 103 days.

(21) Appl. No.: 11/574,578

(22) PCT Filed: Jun. 24, 2005

(86) PCT No.: PCT/CN2005/000913

§ 371 (c)(1),
(2), (4) Date: Jul. 25, 2008

(87) PCT Pub. No.: WO2006/024210

PCT Pub. Date: Mar. 9, 2006

(65) Prior Publication Data

US 2009/0145282 A1 Jun. 11, 2009

(30) Foreign Application Priority Data

Sep. 1, 2004 (CN) ..... 2004 1 0073682

(51) Int. Cl.
*G10D 1/02* (2006.01)

(52) U.S. Cl. ..... 84/276; 84/275; 84/274

(58) Field of Classification Search ..... 84/274–276
See application file for complete search history.

(56) References Cited

U.S. PATENT DOCUMENTS 360,317 A * 3/1887 Loppentien ..... 84/275
468,114 A * 2/1892 McNichol ..... 84/275
496,397 A * 5/1893 Clopton ..... 84/294
627,067 A * 6/1899 Simpson ..... 84/268
1,278,707 A * 9/1918 Martin ..... 84/275
1,413,916 A * 4/1922 Kincannon ..... 84/274
1,819,796 A * 8/1931 Sherman ..... 84/276
2,489,169 A * 11/1949 Virzi ..... 84/275
3,494,239 A * 2/1970 Kasha ..... 84/276
4,061,068 A * 12/1977 Stetson et al. ..... 84/275
4,372,189 A * 2/1983 Johnson ..... 84/276
4,836,076 A * 6/1989 Bernier ..... 84/275

(Continued)

FOREIGN PATENT DOCUMENTS

CN 2243705 Y 12/1996

(Continued)

*Primary Examiner*—Jeffrey Donels
*Assistant Examiner*—Robert W Horn
(74) *Attorney, Agent, or Firm*—Knobbe, Martens, Olson & Bear, LLP

(57) ABSTRACT

A violin can have a longitudinal bass bar located to the right of the middle line in the front and two transverse bass bars located to both left side and right-side of the longitudinal bass bar respectively. The transverse bass bars can be in the upper half of the lower semicircle of the front plate. A lower longitudinal bass bar can be located to the left of the middle line in the back and two other transverse bass bars can be located to both left-side and right-side of the lower longitudinal bass bar respectively and the transverse bass bars can be in the upper half of the lower semicircle of the back plate. An upper longitudinal bass bar can be located to the left of the middle line in the upper half of back plate. Twelve harmonious overtones in octave may be generated in the violin.

15 Claims, 2 Drawing Sheets

U.S. PATENT DOCUMENTS

| | | | | |
|---|---|---|---|---|
| 4,838,140 | A * | 6/1989 | Meissner | 84/275 |
| 5,325,756 | A * | 7/1994 | Sugden | 84/277 |
| 5,381,714 | A * | 1/1995 | Kasha | 84/276 |
| 6,610,915 | B2 * | 8/2003 | Schleske | 84/291 |
| 7,166,788 | B2 * | 1/2007 | Wyman | 84/291 |
| 7,301,085 | B2 * | 11/2007 | Wyman | 84/291 |
| 2009/0145282 | A1 * | 6/2009 | Wang | 84/276 |

FOREIGN PATENT DOCUMENTS

| | | |
|---|---|---|
| EP | 0138240 | 4/1985 |
| WO | WO93/04463 | 3/1993 |

* cited by examiner

VIOLIN WITH STRUCTURAL INTEGRITY

CROSS-REFERENCE TO RELATED APPLICATIONS

This application is a national stage application under 35 U.S.C. §371 of PCT Application No. PCT/CN2005/000913 designating the United States, filed Jun. 24, 2005. The PCT Application was published in Chinese as WO 2006/024210 A1 on Mar. 9, 2006 and claims the benefit of the earlier filing date of Chinese Patent Application No. 200410073682.5, filed Sep. 1, 2004. The contents of Chinese Patent Application No. 200410073682.5 and International Application No. PCT/CN2005/000913 including the publication WO 2006/024210 A1 are incorporated herein by reference in their entirety.

FIELD OF THE INVENTIONS

The present invention relates to a kind of musical instruments, in particular a kind of violins.

BACKGROUND OF THE INVENTIONS

Since the 16th century, violin making has undergone great development in Italy. However there has not been any major changes in the structure of violin. A traditional violin includes the scroll, scroll edge, pegbox, peg, fingerboard, neck, end-pin, sound post, bass bar, front, back, purfling, upper rib, corner block 4, middle rib, lower rib, f hole, bridge, tailpiece, end-button, chin rest and neck pin. A detailed description of the structure and components of a violin is given in, for example, "Violin and violinist" (Second version, 1969, Basrrie & Rockliff, Cresset Press).

In a Chinese patent titled "Improvement on violin" (ZL88101240), a kind of improved violin is disclosed, with the materials for making a violin being specified.

In a Chinese patent titled "Noiseless violin with high pure tone" (ZL00118579.9), a kind of improved violin is described, with the location of the sound post being specified.

Both of the above two patents are directed to providing a violin with better tone. However, they have a common defect, that is, a complete harmonious overtone (i.e. partial tone) can't be produced. So they are not integrate structurally.

The vibration of a sound wave brings about with it an overtone which vibrates slightly. Not all the overtones are harmonious. Only a vibration system with harmonious overtones (i.e. partial tone) can produce a smooth and pleasant tone. This is almost the same for all musical instruments (see "Vibration and sound", Page 84, by P. M., Mores (U.S.A), Science & Technology Publishing House, 1974). In "Vibration and sound", the principle and mechanism for producing of overtone is also described.

The first type of violin made about 500 years ago has an internal structure of lattices. The simple structure of such a lattice can only produce 3 to 4 overtones in an octave. Therefore the sound it produces isn't smooth, pleasant or rich enough. A talented violinist in 16th century made a renovation in the violin structure. The lattices were replaced by the present bass bar, which divides the upper arch and lower arch of the sound box into four zones of different areas. According to the explanation on the mechanism of producing overtone in "Vibration and sound", these zones are made so that each of them can produce an overtone by vibration. The top arch and lower arch of the back are made to produce two overtones caused by slight vibration. As a result, some good violins can have as much as 6 overtones and, for certain violins made by Italian masters, 7 overtones.

As we know, music exists in 12 equal laws. The 6 or 7 overtones produced by slight vibration in an octave are incomplete. A real completeness can only be achieved only with a violin on which slight vibration can produce 12 overtones in an octave. The sound produced by such a violin would be the richest, most balanced, most pleasant and have the most harmonious chord.

SUMMARY OF THE INVENTIONS

An object of at least one of the inventions disclosed herein is to provide a violin which can produce 12 overtones in an octave through slight vibration.

The violin with structural integrity, which at least some of the present inventions relate, can be equipped with a transverse bass bar respectively on the left side and right side of a longitudinal bass bar in the lower semicircle of the front plate. A longitudinal bass bar can be installed to the left of the central line in the lower half of the back plate. A transverse bass bar can also be installed on the left side and right side of the lower longitudinal bass bar in the upper half of the lower semicircle.

An upper longitudinal bass bar can be located to the left of the central line in the upper half of the back plate.

The two transverse bass bars on the front can be connected to the longitudinal bass bar. The two transverse bass bars on the back can be connected with the lower longitudinal bass bar.

The distance between the top end of the lower longitudinal bass bar on the back and the central line can be shorter than that between the lower end and the central line. The distance between its top end of the upper longitudinal bass bar on the back and the central line can be shorter than that between its lower end and the central line.

The two transverse bass bars on the front can be on the same beeline. The two transverse bass bars on the back can be on the same beeline.

The distance from the left end, transverse bass bar on the left side of the front plate, to the left edge of the front can be equal to the distance from the right end, transverse bass bar on the right side of the front plate, to the right edge of the front plate.

The distance from the left end, transverse bass bar on the left side of the back plate, to the left edge of the front can be equal to the distance from the right end, transverse bass bar on the right side of the back plate, to the right edge of the back plate.

The width and thickness of the right and left transverse bass bars on the front can be the same as those of the right and left transverse bass bars on the back plate. The thickness of the right and left transverse bass bars on the back can be the same as that of the lower longitudinal bass bar, but larger than that of the upper longitudinal bass bar. The width of the right and left transverse bass bars on the back can be the same as that of the upper longitudinal bass bar, but smaller than that of the lower longitudinal bass bar.

The two transverse bass bars on the front can be made of the same material as the longitudinal bass bar. The two transverse bass bars on the back can be made of the same material as the upper and lower longitudinal bass bars.

The violins so far available are often equipped with one longitudinal bass bar near to the central line on the front plate. This bass bar divides the upper semicircle 1 and the lower semicircle into four zones of different areas, where 4 overtones can be produced. Two overtones can be made in the lower semicircle of the back plate. Some violins made by the Italian masters can produce one additional overtone. Such violins can produce six or seven overtones.

The upper semicircle and lower semicircle of the front of the violin which at least some of the present inventions relate can be divided into six zones of different areas. The area of each zone on the left side can be larger than that of the corresponding zone on the right. Forming the relevant zones of the front in the order from largest area to the smallest area can be performed with techniques such as scraping, rubbing, adjusting the thickness of the front plate, etc. As such, they can produce C, D, E, ♯F, ♯G and ♯A, altogether 6 overtones in an octave. The upper semicircle 1 and lower semicircle 2 of the back of the violin can also be divided by the longitudinal bass bar into six zones of different areas, with the area of each zone on the left side being larger than that of the corresponding zone on the right. The relevant zones of the back can be formed in the order from largest area to the smallest area so they can produce ♯C, ♯D, F, G, A and B, altogether 6 overtones in the same octave. The combination of the overtones produced on the front and back is complete 12 overtones, i.e. C, ♯C, D, ♯D, E, F, ♯F, G, ♯G, A, ♯A, and B in an octave (an overtone marked with an underline indicates that it is produced by the back plate).

However, the above C overtone is within one octave. As the sound caused by the air flow inside the violin increases or decreases, the overtone from the back will also increase or decrease. As shown in FIG. 1 when C overtone in No 9 range increases or decreases, the other 11 overtones will also increase or decrease, thus these 12 overtones can be within the same octave.

A violin in accordance with at least one of the embodiments disclosed herein can produce at least 5 additional overtones than a conventional violin. As to a current available violin, 3.5 octaves is effected in the upper half and lower half of the violin respectively, that is to say, there are all together only 8 octaves. Such a violin can produce 56 overtones ($7\times8=56$, without considering the overtones caused by the air flow). A total of 96 ($12\times8=96$) overtones can be produced inside a violin in accordance with at least one of the embodiments disclosed herein, 40 more than that those can be produced by a conventional violin. Each musical note produced with it is richer and more pleasant to an extent of 70% ($40\div56\approx0.7$). Any chord would be harmonious, extremely balanced and smooth and pleasant and can be played with ease by the left hand. As such, the present violin a next generation violin with the most complete structure.

In America, a violin made in China is sold at two or three hundred USD. A violin made by a worker who has recently completed his apprenticeship is sold at three or four hundred USD in USA. On the other hand, a manual made violin from USA is sold between 10,000 to 30,000 USD. The annual export of violins by China is about 600,000. If violins in accordance with the present embodiments were used to replace the currently exported violins, more value would be achieved and more contribution would be made for the national economy.

DETAILED DESCRIPTION OF THE PREFERRED EMBODIMENTS

The inventions disclosed herein are described in the context of a violin because they have particular utility in this context. However, these inventions can also be used in other environments of use, such as other stringed instruments, or other devices relying on principles of vibrational mechanics.

Figure 1:
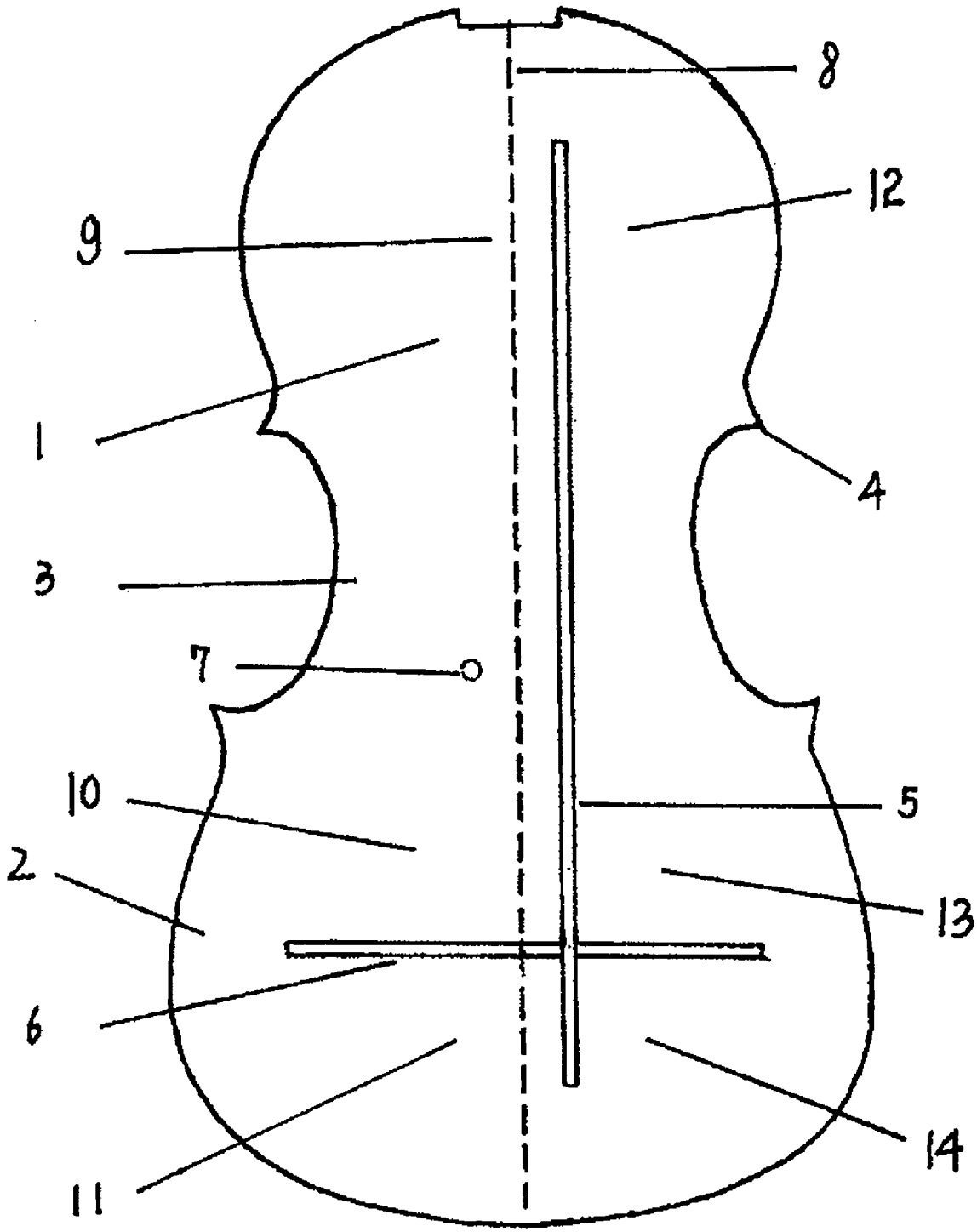
FIG. 1 is a diagram of the inside of the front of the violin in accordance with an embodiment.

With reference to FIG. 1 in which the front plate of a violin in accordance with an embodiment is illustrated, the external diameter of the upper semicircle 1 of the front can be 154-157 mm, the internal width of the belly 3 can be modified to 105.5-107 mm, the external diameter of the lower semicircle 2 can be 201-204 mm, and the entire violin body can be extended to 355-357 mm (the external rib is 2.4 mm thicker, with perfling of 4.4 mm, the entire length of the violin plate is 361.8-363.8 mm).

In manufacturing such a violin, after preparing the surface of the front plate, then hollow the front plate. For example, starting along the central line 8 from the lower end of the front upward to 76-78 mm inside the front plate, draw a line perpendicular to the central line 8 (the net distance inside the plate 72.6-74.6 mm+thickness of rib 1.2 mm+purfling 2.2 mm), then draw a parallel line 3.8-4.5 mm further up. These two lines can be the location for the transverse bass bar 6. A longitudinal bass bar 5 can be located to the right side of the central line 8, by means of the current technologies. Then one bass bar of the same material, which is 79-82 mm long and 3.8-4.5 mm wide, and can be positioned close to or connected with the left side of the longitudinal bass bar 5.

The position for the transverse bass bar 6 can be made to match with the front plate. A glued structure can be made with a height of 4.8-5 mm. The same method can be used to make one bass of the same material, which is 54-57 mm long and 3.8-4.5 mm wide, and it should be close to or be connected with the right side of the longitudinal bass bar 5. The position lines of the transverse bass bar 6 can also match with the front plate. Then a glued structure with a height of 4.8-5.1 mm can be made.

Therefore the upper semicircle 1 of the front is divided into two vibration zones by the longitudinal bass bar 5, with the area of the left-side zone being larger than that of the corresponding right-side zone. The lower semicircle 2 of the front is divided into two vibration zones by the longitudinal bass bar 5 and the area of the left-side zone is also larger than that of the corresponding right-side zone. Because the areas of these six zones are different, the slight vibrations they produce aren't the same and hence the sounds they produced. The surface of each vibration zone can be scraped to cause the three vibration zones on the left side to produce 3 overtones, i.e. C, D and E, and the three vibration zones on the right side can produce 3 overtones, i.e. ♯F, ♯G and ♯A.

How can the above specific overtones can be produced in each zone? The following method may be employed. Use A turning fork to attune the A string of any a violin that is available. Then bow a chord with A string together with E string, and A string together with D string, respectively. So that E string and D string are attuned. Then bow a chord with D string and G string to attune G sting. Then the current violin has been attuned. On the No. 1 Small Letter Group on G string, set the six overtones to be produced by the front plate (respectively are C, D, E, ♯F, ♯G and ♯A in the order from largest vibration area to smallest vibration area). Knock over each zone of the front plate, Scrape the front in the relevant zone according to their differences with the corresponding overtone produced on the small character group on G string. Keep on scraping until a corresponding overtone can be produced on the specific zone of the front plate. Attune it with the overtone produced with G string. At this stage, the six specific zones of the front can produce six overtones in an octave.

With reference to FIG. 1, the reference numeral 9 identifies the C range, 10 identifies the D range, 11 identifies the E range, 12 identifies the ♯F range, 13 identifies the ♯G range, and 14 identifies the ♯A range.

Figure 2:
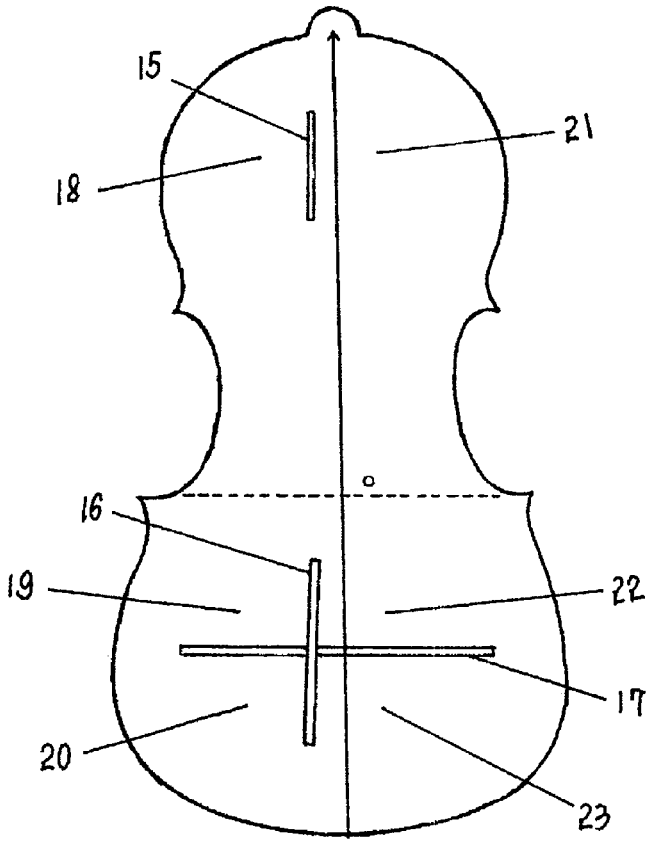
FIG. 2 is a diagram of the inside of the back of the violin of FIG. 1.

With reference to FIG. 2, the back can be prepared to counter the front plate. In one method of manufacturing, one can hollow the black plate after the surface has been prepared. Starting along the central line 8 from the lower end of the front upward to 81-83 mm, draw a line perpendicular to the central line 8 inside the front plate, (the net distance inside the plate 77.6-79.6 mm+thickness of rib 1.2 mm+purfling 2.2 mm), then draw a parallel line 3.8-4.5 mm further up. Staring along the central line 8 from the upper end of the back upward to 41-43 mm (net distance on the plate 124.6 mm+rib thickness 1.2 mm+purfling 2.2 mm), make a marking on a position 12.5-13.1 mm to the left. Then staring from the central line 8 upward to 41-43 mm (net distance on the plate 37.6-39.6 mm+rib thickness 1.2 mm+purfling 2.2 mm), make a marking on a position 10.8-12.4 mm to the left. Draw a longitudinal line connecting these two markings. Then draw one parallel line 4.8-5.5 mm to the left. These two lines are the location for the lower transverse bass bar 17 6.

Make one bass bar which is 86.8-88 mm long and 4.8-5.5 mm wide. Cause the position lines for the lower longitudinal bass bar 16 to match with the black plate. Then make a glued structure with a height of 4.8-5.1 mm, which constitutes the lower longitudinal bass bar 16. Make a bass bar 17 of the same material, with a length of 86-89 mm and a width of 3.8-4.5 mm. Cause this transverse bar 17 to be close or connected to the lower longitudinal bass bar 16 at the position for the transverse bass bar 17 and match it with the back plate. Then make a glued structure with a height of 4.8-5.1 mm, which constitute the lower longitudinal bass bar 16. Make one bass of the same material, which is 86-89 mm long and 3.8-4.5 mm wide. Cause this bass bar to be close to or be connected with the right side of the lower longitudinal bass bar 16 at the position lines for the transverse bass bar 17 and cause it to match with the back plate. Then make a glued structure with a height of 4.8-5.1 mm. Make one bass bar which is 54-57 mm long and 3.8-4.5 mm wide. Cause this bass bar to be close to or be connected with the left side of the lower longitudinal bass bar 16 at the location line for the transverse bass bar 17 and cause it to match with the back plate. Make a glued structure with a height of 5 mm.

Starting along the central line 8 from the upper end downward to 39-42 mm (net distance on the plate 35.6 mm+rib thickness 1.2 mm+purfling 2.2 mm), make a marking on a position 10.8-11.1 mm to the left. Then starting along the central line 8 along the central line 8 downward to 94-97 mm (net distance on the plate 90.6-93.6 mm+rib thickness 1.2 mm+purfling 2.2 mm), make a marking on a position 11.8-12.1 mm to the left. Draw a longitudinal line connecting these two markings. Then draw one parallel line 3.8-4.5 mm further to the left. These two lines are the position lines for the upper transverse bass bar 17 6. Make a bass bar of the same material, with a length of 54-57 mm and a width of 3.8-4.5 mm. Cause the position lines for the upper longitudinal bass bar 5 to match with the front plate. Then make a glued structure with a height of 3.8-4.1 mm, which constitutes the lower longitudinal bass bar 5.

So the upper semicircle 1 of the back is divided into two zones, with the zone area on the left side being larger than that on the right side. The lower semicircle 2 of the back is divided into four zones by the transverse bass bar 17 6 and the longitudinal bass bar 5, and the area of the left-side zone is also larger than that of the corresponding right-side zone. Because the areas of these six zones are different, the slight vibrations they produce aren't the same and hence the sounds they produced. Scrape the surface of each vibration zone using the same method for the front plate, and cause the three vibration zones on the left side produce 3 overtones, i.e. G, A and B in the same octave (as the overtones produced on the front plate), and the three vibration zones on the right side (from top to bottom) to produce 3 overtones, i.e. ♯C, ♯D and F in the same octave (as the overtones produced on the front plate).

Since the fibers of the back are longitudinal and the upper semicircle 1 is smaller than the lower semicircle 2, an upper longitudinal bass bar 5 isn't necessary. Scrape the left and right part of the upper semi circle, causing the left part to produce G overtone and the right part to produce ♯C overtone. In the lower semicircle 2 of the back plate, the longitudinal bass bar 5 or the transverse bass bar 17 6 can't omitted, because four zones for producing overtones are to be set.

With continued reference to FIG. 2, the reference numeral 18 identifies the G range, 19 identifies the A range, 20 identifies the B range, 21 identifies the ♯C range, 22 identifies the ♯D range, and 23 identifies the F range.

Figure 3:
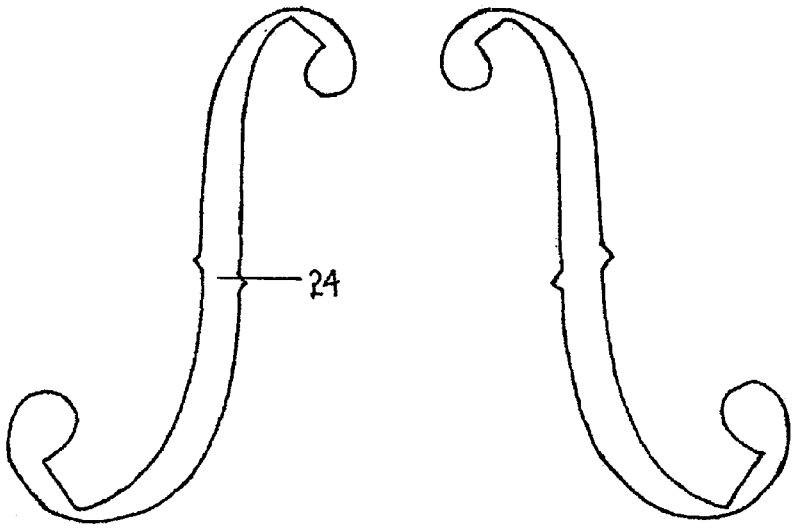
FIG. 3 is a diagram of f-hole of the violin of FIG. 1.

With reference to FIG. 3, the f-hole 24 can be positioned to be in line with the area of the part above the transverse bass bar 6 in the lower semicircle 2 of the front plate. The center of f-hole 24 can be 195 mm away from the upper edge of the front plate. The external distance between the left and right f-holes 24 is 135.5-137 mm and the internal distance can be 44.5-46 mm. The longitudinal height can be 73-74.1 mm and the central openings of two f-holes 24 can be symmetrically inclined ones.

The rib height in the above case: 32-32.8 mm at the lower tailpiece, 31.5-32.1 mm at the lower corner block 4, 30.8-31.1 mm at the upper corner block 4, 29.8-30.1 mm at the upper neck.

The material for the violin may be either hard or soft material. The current technologies for producing strong or pleasant overtones and the thickness of the violin plates and the styles used nowadays can be employed. For example, the above data on structure may be input into a universal carving machine made in Germany or Japan Then the front and the back of the above structure can be produced in a semi automatic or fully automatic process. The currently available products may be used as the other auxiliaries and fittings of the violin and a complete violin can be assembled using the current technologies.

The present invention covers violin (see above for details) as well as viola or cello or violone, as well as the various different sizes of each instrument. The latter three instruments have lower sound that a violin and a larger sound-producing area. The longitudinal and transverse bass bars on them may be proportionally increased according to the structures described above. Thus, one of ordinary skill in the art can adjust the exemplary dimensions disclosed herein to accommodate these various different instruments and their varying sizes.

All the current violin-making technologies can be applied on the violin which the present inventions relate. It can be produced with ease and ready for industrial production. If a universal carving machine is used for machining the front and the back and the assembling of entire violin, a large-scale batch production would be possible.

What is claimed is:

1. A violin with structural integrity, comprising a back plate with only a first upper longitudinal bar and a second lower longitudinal bar connected to the back plate, the second lower longitudinal bar being positioned to the left of a central line in the lower part of the back plate, a right side transverse bar positioned on the right side of the second lower longitudinal bar and a left side transverse bar positioned on the left side of the second lower longitudinal bar in the upper part of the lower semicircle.

2. A violin with structural integrity as in claim 1, wherein the first upper longitudinal bar is positioned to the left of the central line in the upper part of the back plate.

3. A violin with structural integrity as in claim 2, wherein the first upper longitudinal bar is shorter than the second lower longitudinal bar.

4. A violin with structural integrity as in claim 1, further comprising a front plate, a third longitudinal bar on the front plate, and two transverse bars on the front connected to the third longitudinal bar, and wherein the right and left transverse bass bars on the back are connected to the second lower longitudinal bar.

5. A violin with structural integrity as in claim 2, wherein a distance from an upper end of the second lower longitudinal bar on the back to the central line is shorter than that from a lower end of the second lower bar to the central line, and wherein the distance from an upper end of the first upper longitudinal bar to the central line is shorter than that from a lower end of the first upper longitudinal bar to the central line.

6. A violin with structural integrity as in claim 3, wherein the distance from an upper end of the second lower longitudinal bar on the back to the central line is shorter than that from a lower end of the second lower longitudinal bar to the central line, and wherein the distance from an upper end of the first upper longitudinal bar to the central line is shorter than that from the lower end of the first upper longitudinal bar to the central line.

7. A violin with structural integrity as in claim 1, further comprising a front plate, a third longitudinal bar on the front plate, and two transverse bars on the front plate, wherein the two transverse bars on the front are at the same beeline, and wherein the left and right transverse bars on the back are at the same beeline.

8. A violin with structural integrity as in claim 1, wherein the two transverse bars on the front plate include left and right side transverse bars, wherein the left side transverse bar of the front plate is longer than the right side transverse bar, and wherein the left side transverse bar on the back plate is shorter than the right side transverse bar.

9. A violin with structural integrity as in claim 5, wherein the two transverse bars on the front plate include left and right side transverse bars, wherein the left side transverse bar of the front plate is longer than the right side transverse bar, and wherein the left side transverse bar on the back plate is shorter than the right side transverse bar.

10. A violin with structural integrity as in claim 1, wherein the distance from the left end, transverse bar on the left side of the front plate, to the left edge of the front is equal to the distance from the right end, transverse bar on the right side of the front plate, to the right edge of the front plate; the distance from the left end, transverse bar on the left side of the back plate, to the left edge of the front is equal to the distance from the right end, transverse bar on the right side of the back plate, to the right edge of the back plate.

11. A violin with structural integrity as in claim 5, wherein the distance from the left end, transverse bar on the left side of the front plate, to the left edge of the front is equal to the distance from the right end, transverse bar on the right side of the front plate, to the right edge of the front plate, the distance from the left end, transverse bar on the left side of the back plate, to the left edge of the front is equal to the distance from the right end, transverse bar on the right side of the back plate, to the right edge of the back plate.

12. A violin with structural integrity as in claim 2, wherein the width and thickness of the right and left transverse bars on the front are the same as those of the right and left transverse bars on the back plate; the thickness of the right and left transverse bars on the back are the same as that of the lower longitudinal bar, but larger than that of the upper longitudinal bar; the width of the right and left transverse bars on the back are the same as that of the upper longitudinal bar, but smaller than that of the lower longitudinal bar.

13. A violin with structural integrity as in claim 3, wherein the width and thickness of the right and left transverse bars on the front are the same as those of the right and left transverse bars on the back plate; the thickness of the right and left transverse bars on the back are the same as that of the lower longitudinal bar, but larger than that of the upper longitudinal bar; the width of the right and left transverse bars on the back are the same as that of the upper longitudinal bar, but smaller than that of the lower longitudinal bar.

14. A violin with structural integrity as in claim 2, wherein the two transverse bars on the front are made of the same material as the longitudinal bar; the two transverse bars on the back are made of the same material as the upper and lower longitudinal bars.

15. A violin with structural integrity as in claim 3, wherein the two transverse bars on the front are made of the same material as the longitudinal bar; the two transverse bars on the back are made of the same material as the upper and lower longitudinal bars.

* * * * *